United States Patent [19]

Yurasko, Jr.

[11] 4,230,750

[45] Oct. 28, 1980

[54] METALLO-THERMIC POWDER

[75] Inventor: George Yurasko, Jr., Glencove, N.Y.

[73] Assignee: Eutectic Corporation, Flushing, N.Y.

[21] Appl. No.: 66,876

[22] Filed: Aug. 15, 1979

Related U.S. Application Data

[62] Division of Ser. No. 962,673, Nov. 21, 1978.

[51] Int. Cl.[3] ..... B05D 1/10

[52] U.S. Cl. ..... 427/423; 428/937

[58] Field of Search ..... 75/252, 255, 0.5 R; 427/34, 423; 428/939

[56] References Cited

U.S. PATENT DOCUMENTS

| | | | |
|---|---|---|---|
| 2,904,449 | 9/1959 | Bradstreet | 427/423 |
| 2,943,951 | 7/1960 | Haglund | 427/423 |
| 3,322,515 | 5/1967 | Dittrich et al. | 428/651 |
| 3,617,358 | 11/1971 | Dittrich | 427/423 |
| 4,031,278 | 6/1977 | Patel | 427/423 |
| 4,039,318 | 8/1977 | Patel | 427/423 |

*Primary Examiner*—Shrive P. Beck

*Attorney, Agent, or Firm*—Hopgood, Calimafde, Kalil, Blaustein and Lieberman

[57] ABSTRACT

A flame spray powder mix is provided for producing coatings on metal substrates, such as substrates of steel, cast iron, non-ferrous metals, among other substrates, the powder mix comprising agglomerates of a metallo-thermic heat generating composition (i.e., a thermic composition, such as an alumino-thermic composition) mixed with at least one coating material, such as metal and/or non-metal coating materials.

16 Claims, 6 Drawing Figures

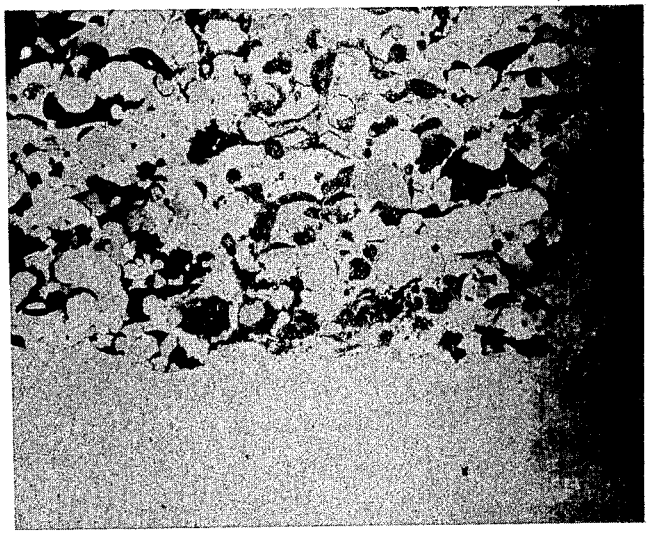
FIG. 5 x160
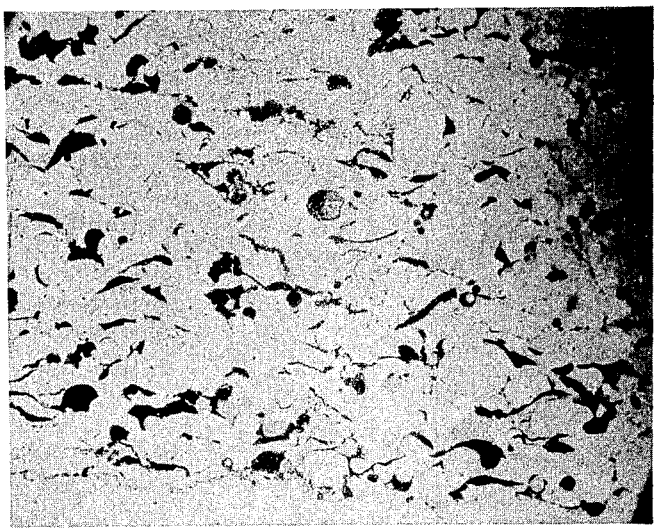
x160
FIG. 6

METALLO-THERMIC POWDER

This is a division of copending application Ser. No. 962,673, filed Nov. 21, 1978.

This invention relates to a flame spray powder mix or blend and to a flame spray method therefor. In particular, the invention relates to a flame spray powder mix or blend constituted of agglomerates of a metallo-thermic heat generating composition mixed or blended with a powder of coating material for spraying onto a substrate, said metallo-thermic composition in agglomerate form being characterized when flame sprayed together with the coating material of substantially instantaneously producing a plurality of concentrated highly exothermic heat generating sites in intimate heat transfer relationship with said coating material, whereby the coating material is efficiently superheated to a bonding temperature effective for producing an adherent coating on said substrate.

STATE OF THE ART

It is known to coat metal substrates with a flame spray material to protect said metal substrates, such as a ferrous metal substrate, including steel and the like, and impart thereto improved properties, such as resistance to corrosion, and/or oxidation, and/or wear, and the like. The material sprayed, e.g., metals, may be in the form of a wire or a powder, powder spraying being a preferred method.

In order to provide a substrate with an adherent coating, it is the practice to clean the substrate and shot blast it with steel grit or thread the surface thereof on a lathe, if the shape is cylindrical, before depositing the metal coating thereon.

In U.S. Pat. No. 3,322,515, a method is disclosed for providing an adherent coating onto a metal substrate by first cleaning the substrate and flame spraying a metal bond coat therein using a flame spray powder in which elemental nickel and aluminum are combined together to form a composite particle, for example, a clad particle. This type of powder which is referred to in the trade as bond coat powder provides a basis layer by means of which a sprayed overlayer of other metals and alloys of substantial thickness is adherently bonded to the metal substrate. With this technique, fairly thick overlayers can be produced.

According to the patent, the nickel and aluminum in the composite particles react exothermically in the flame to form an intermetallic compound (nickel aluminide) which gives off heat which is intended to aid in the bonding of the nickel-aluminum material to the metal substrate, the intermetallic compound forming a part of the deposited coating.

It is known in the patent literature to employ aluminum powder simply mixed with the particulate coating material to enhance the flame spraying thereof by using the heat of oxidation of aluminum which is substantially greater than the amount of heat released in the formation of the nickel aluminide intermetallic compound. A patent utilizing the foregoing concept is the Bradstreet U.S. Pat. No. 2,904,449 which discloses the use of a flame catalyst, e.g., aluminum, capable of catalyzing the oxidation reaction being carried out in the flame to thereby raise the flame temperature. Another patent along substantially the same line is Haglund U.S. Pat. No. 2,943,951.

A thermit process is known which utilizes the redox reaction of a metal oxide with a strong reducing agent, such as aluminum, which generates a great deal of heat due to oxidation by reaction with the metal oxide. The thermit reaction as generally practiced comprises mixing granulated aluminum with a metal oxide, such as iron oxide, to produce an enormous amount of heat for use in on-the-spot welding by reduction of the iron oxide to iron or for use in incendiary bombs. By employing a closely associated and confined thermit mixture with the metal oxide in intimate contact with aluminum, an enormous amount of heat is instantaneously generated which is immediately accompanied by a large increase in temperature (adiabatic).

However, it has been difficult to obtain full use of such an adiabatic reaction in flame spraying. For example, the oxidation methods disclosed in the aforementioned U.S. Pat. Nos. 2,904,449 and 2,943,951 have their limitations in that as the material passes through the flame spray nozzle, they spread apart and do not have the desired close association required to make full and efficient use of the thermit reaction.

Moreover, although coatings are produced by the foregoing process, the adherence is not all that is desired. It is important in producing a first or bond coat layer on a metal substrate that it be capable of taking on a second or third coat of another coating material without lifting off. In other words, it must have a fairly high bond strength if it is to be useful as a basis layer for the subsequent application of an overlayer of fairly substantial thickness.

It is known to agglomerate powder materials to produce a flame spray powder. U.S. Pat. No. 3,322,515 previously discussed discloses such agglomerated material comprising, for example, nickel powder agglomerated with a resin adhesive to aluminum powder, such as by cladding.

In U.S. Pat. No. 4,039,318, a metaliferous flame spray material is disclosed, formed of a plurality of ingredients physically combined together in the form of an agglomerate, the plurality of ingredients in the agglomerate comprising by weight of about 3% to 15% aluminum, about 2 to 15% refractory metal silicide and the balance of the agglomerate essentially a metal selected from the group consisting of nickel-base, cobalt-base, iron-base, and copper-base metals. A preferred combination is at least one refractory metal disilicide, e.g., $TiSi_2$, agglomerated with aluminum and nickel powder. The foregoing combination of ingredients provides metal coatings, e.g., one-step coatings, having improved machinability.

U.S. Pat. No. 3,617,358 discloses a process for producing agglomerates for flame spraying by a well-known technique referred to as spray drying in which a slip containing a binder and a suspension of finely divided material, be it a metal, refractory oxides, refractory carbides, borides, silicides, etc., is spray dried to form agglomerates for use in flame spraying. Various types of mixtures are referred to for agglomeration, including a nickel oxide-aluminum mixture, among others. However, nowhere in the patent is there any appreciation or recognition of how thermit reactions can be employed in oxyacetylene flames to produce coatings having improved bond strength comparable to the use of, for example, plasma flame spray torches which intrinsically provide temperatures much higher than oxyacetylene torches.

I have now discovered that adherent flame spray coatings can be produced by using the metallo-thermic reaction in a special way so that its heat generation capacity is substantially fully realized in the production of firmly bonded coatings.

OBJECTS OF THE INVENTION

It is an object of the present invention to provide a flame spray powder mix capable of producing adherent coatings on a substrate exhibiting improved bond strength.

Another object is to provide a flame spray method that utilizes the thermit process in the production of sprayed coatings which are dense and which exhibit improved bond strength.

These and other objects will more clearly appear from the following disclosure and the accompanying drawing.

THE DRAWING

FIGS. 5 and 6 are representation of photomicrographs taken at 160 times magnification of cross sections of sprayed coatings produced in accordance with other embodiment of the invention.

STATEMENT OF THE INVENTION

Figure 1:
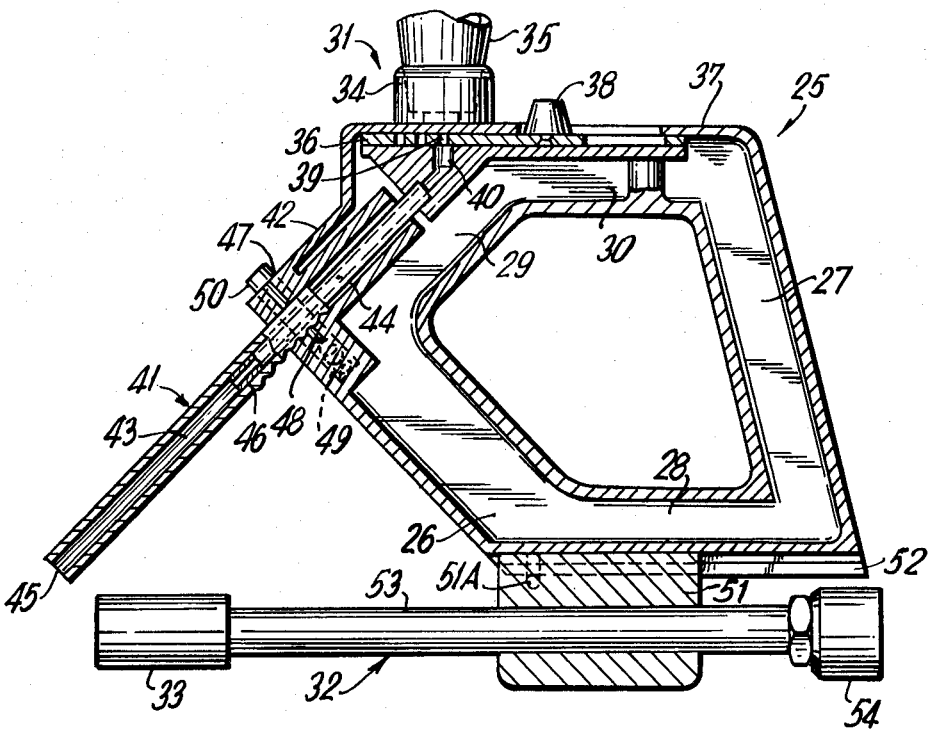
FIG. 1 is illustrative of one type of oxyacetylene flame spray torch which may be employed to spray the powder mix of the invention.

Stating it broadly, one embodiment of the invention is directed to a flame spray powder mixture comprising: (1) agglomerates of a metallo-thermic heat-generating composition comprised essentially of fine particles of a reducible metal oxide formed from a metal characterized by a free energy of oxidation ranging up to about 60,000 calories per gram atom of oxidation referred to 25° C. intimately combined together by means of a thermally fugitive binder with fine particles of a strong reducing agent consisting essentially of a metal characterized by a free energy of oxidation referred to 25° C. of at least about 90,000 calories per gram atom of oxygen, (2) said agglomerates being uniformly mixed with at least one coating material selected from the group consisting of metals, alloys, and oxides, carbides, silicides, nitrides, and borides of the refractory metals of the 4th, 5th, and 6th Groups of the Periodic Table.

It has been found that by employing a metallo-thermic heat generating composition (i.e., a thermit mixture) in agglomerated form and simply mixing it with a coating material, e.g., nickel, among other coating materials, markedly improved bonding results are obtained as compared to using the agglomerated metallo-thermic composition alone followed by a sprayed overlayer.

By employing the metallo-thermic agglomerate, different flame characteristics are obtained which are conducive to the production of strongly adherent coatings.

The term "metallo-thermic" mixture employed herein has reference to a mixture in which one of the powdered ingredients is a reducible metal oxide and the other a strong metallic reducing agent intimately agglomerated together with a thermally fugitive binder, e.g., an organic resin, sodium or potassium silicate, etc.

Preferably the agglomerates and the coating metal powder have an average size falling in approximately the same size range, for example, from about 30 to 150 microns.

The term "average size" means that the average size of all the agglomerates will be such as to preferably range from about 30 to 150 microns. For example, it will be appreciated that some of the agglomerates may have sizes below 30 microns so long as the overall average of the agglomerates is 30 microns and above. Similarly, some of the agglomerates could have sizes above 150 microns so long as the overall average of the agglomerates is 150 microns or less.

What has been said for the agglomerates may apply to the average size of the coating metal powder, although not as rigidly. The terms "powder mix" or "powder mixture" employed herein are meant to cover simple mixtures or blends of the agglomerates and the coating metal powder, the agglomerates being discernible from the particles of coating metal under the microscope. Where the powder mixture is a mixture of the agglomerates and particles of nickel, the nickel powder can be easily separated by a magnet from the agglomerates where the agglomerates are non-magnetic.

The ingredients making up the metallo-thermic agglomerates should be finely divided and should be less than the average particle size of the coating metal. That is to say, the average particle size should preferably be less than about 20 microns, more preferably, less than about 15 microns, such as about 2 to 10 microns. By employing such sizes, large surface area of the reactant powders is assured which aids in maximizing the redox reaction.

Thus, if the metallo-thermic ingredients are NiO and aluminum at an average particle size of about 5 microns, the agglomerates formed therefrom will generally have an average particle size ranging from about 30 to 150 microns similar to the size of the coating metal powder. As stated hereinbefore, the agglomerates are formed using a thermally fugitive binder which is decomposable or vaporizable as the agglomerates pass through the flame.

In this way, a plurality of fine particles of the thermit composition are confined within each agglomerate such that when each agglomerate reacts in the flame, there is a burst of concentrated thermal energy. That is to say, when the agglomerates are flame sprayed as a blended mixture with the coating material, there is produced substantially instantaneously a plurality of concentrated highly exothermic heat generating sites in intimate heat transfer relationship with the coating material, whereby the coating material is efficiently superheated to a bonding temperature effective for producing an adherent coating on the substrate. Each agglomerate provides a spontaneous burst of thermal energy accompanied by a rapid rise in temperature.

As stated earlier, the reducible metal oxide employed in the agglomerate together with the strong oxidizing agent is one exhibiting a negative free energy of formation ranging up to about 60,000 calories per gram atom of oxidation referred to 25° C. Examples of such reducible metal oxides are listed as follows:

| The Oxide | Approximate Negative Free Energy (Calories) |
|---|---|
| FeO | 59,000 |
| $Fe_2O_3$ | 60,000 |
| CoO | 52,000 |
| NiO | 51,000 |
| $Cu_2O$ | 35,000 |
| CuO | 32,000 |
| $Sb_2O_3$ | 45,000 |
| $MoO_2$ | 60,000 |
| $MoO_3$ | 54,000 |
| $WO_2$ | 60,000 |
| $WO_3$ | 59,000 |

Examples of strong oxidizing metals which exhibit a negative free energy of formation of at least about 90,000 calories per gram atom of oxygen referred to 25° C. are given below:

| Oxidizable Metal | The Oxide | Approximate Negative Free Energy (Calories) |
|---|---|---|
| Si | $SiO_2$ | 96,200 |
| Al | $Al_2O_3$ | 125,590 |
| Zr | $ZrO_2$ | 122,000 |
| Be | BeO | 139,000 |

Other oxidizable metals include the rare earth metals, magnesium, barium, among others.

The flame spray powder mix and method provided by the invention enable the production of a dense adherent bond coat by virtue of the super heat generated by the agglomerates. The bond coat also enables the build-up of a top coat thereon of a desired coating composition which adheres strongly to the bond coat without the bond coat lifting off the substrate. The powder mix may be sprayed using various types of metal spray torches well known in the art, particularly oxyacetylene torches. However, plasma spray torches may also be employed. Thus, the term "flame spray" used herein is meant to cover the foregoing types of torches in which the powder mix is injected into the flame, be it an oxyacetylene flame or a plasma flame, and the heated powder then applied to the metal substrate.

A preferred torch is that disclosed in U.S. Pat. No. 3,620,454 which is adapted for gravity feed of the powder externally to the flame issuing from a nozzle, the torch being depicted in FIG. 1.

DETAILS OF THE INVENTION

The powder mix of the invention enables the production of a one-step coating of substantial thickness ranging up to about 0.25 inch, for example, about 0.01 to 0.125 inch.

A preferred oxyacetylene torch is that shown in FIG. 1. The flame spray torch 25 shown may be adapted for gravity feed of flame spray powder directly to the flame issuing from the nozzle as shown, or the powder feed may be automated by injection with a carrier gas under pressure (e.g., such as argon) from a powder feed unit. This torch is particularly applicable for the spraying of metallo-thermic compositions because of the external feed.

The torch has a housing in the shape of a fivesided polygon with one leg of the polygon arranged as a handle portion 27, another leg as a base portion 28, a further leg as a feed portion 29, and another leg 30 of the polygon as the top portion of the torch. The housing 26 has coupled to it a powder feed assembly 31 and a flame assembly 32 to which is coupled nozzle 33.

The top leg portion 30 is provided with a fitting 34 adapted to receive a receptacle 35 (shown fragmentarily) for holding the flame spray powder, a metering device being employed to control powder feed comprising a feed actuator plate 36 slidably mounted in a slot 37 located in the housing top portion 30 below fitting 34. Feed plate 36 is provided with a knob 38 which protrudes upwardly above the housing and permits the sliding of feed plate 36 reciprocally toward and away from housing feed portion 29.

The agglomerates and powder mix flow by gravity unhindered through circular orifices which may range in size from 0.075 to 0.120 inch for different powders, the flow being maintained substantially constant over a mesh size range of minus 100 to plus 325 mesh.

In achieving the desired flow rate, feed plate 36 is selectively aligned with powder flow orifice 39 to control variably the flow rate of the powder from receptacle 35 through flow orifice 39 through conduit 40 and through variable spray control assembly 41. Assembly 41 has a housing 42 which holds a powder feed tube 43 and having a central core hollow cylinder 44 slidably and telescopically fitted within feed tube 43 and communicating directly with powder flow conduit 40 to deliver powder directly by gravity to feed tube 43, the powder then flowing through discharge end 45. A portion of the outer surface of feed tube 43 is provided with indexing means or grooves 46 which through latching assembly 47 enables the setting of powder feed tube 43 in order to locate discharge end 45 at the correct distance from the flame end of nozzle 33. The latching assembly comprises a holding pin 48 that is normally urged toward one of the indexing grooves 46 by spring 49, the holding pin 48 being actuated by rod 50 in making the setting. Thus, by depressing rod 50, the pin is moved out of contact with one of the indexing grooves and tube 43 set according to the desired position.

The flame assembly 32 is supported by sliding element 51 which can be lockingly moved along a track 52 located at the bottom leg 28 of housing 26, a locking pin 51A being provided as shown. Gas flow tube 53 is fixedly held by sliding element 51 and may be factory set, one end of the tube having a connector 54 for attaching to a source of oxygen and acetylene.

The powder flows down tube 43 and is discharged at 45 into the flame issuing from nozzle 43. The powder is sprayed on a metal substrate, e.g., a steel shaft, at about six to eight inches from the workpiece.

When the powder mix of the invention is fed by gravity into an oxyacetylene flame, an unexpected flame characteristic is obtained as compared to the flame characteristic obtained when flame spraying a prior powder comprising an agglomerate of 95% nickel and 5% aluminum held together by a fugitive binder. This is the system which is alleged to form an intermetallic compound as described in U.S. Pat. No. 3,322,515.

Figure 2:
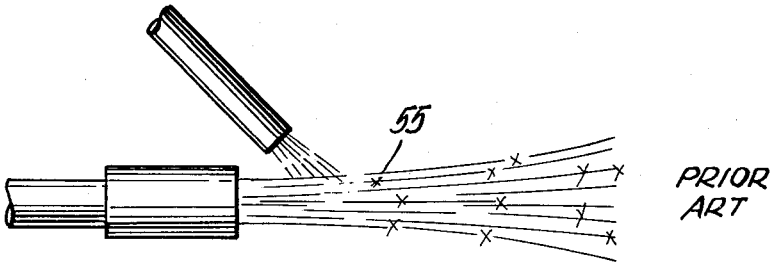
FIG. 2 depicts the contour of a typical flame spray issuing from the nozzle of an oxyacetylene torch of the type shown in FIG. 1.
Figure 3:
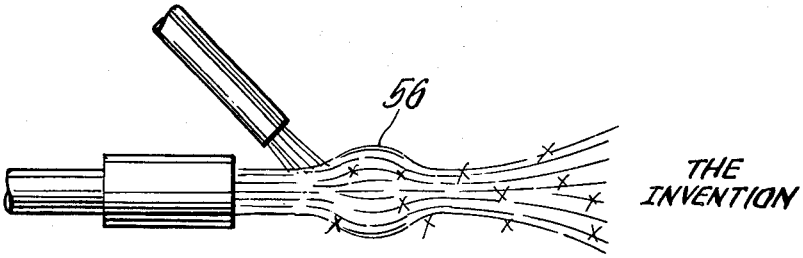
FIG. 3 is illustrative of a modified contour of a flame spray issuing from the nozzle of a flame spray torch as in FIG. 1 when using the flame spray powder mix of the invention.

For example, referring to FIG. 2, when a composite agglomerate of the system 95% Ni-5% Al is fed into the flame, the flame exhibits a gradual outwardly tapered contour 55 as shown, typical of a low order reaction. However, when the metallo-thermic composition of the invention is fed into the flame as in FIG. 3, a large, bright, intensely hot fireball 56 of ovoid configuration is formed forward of the nozzle which super heats the coating material to extremely high temperatures as compared to the lower temperature flame of FIG. 2.

Figure 4:
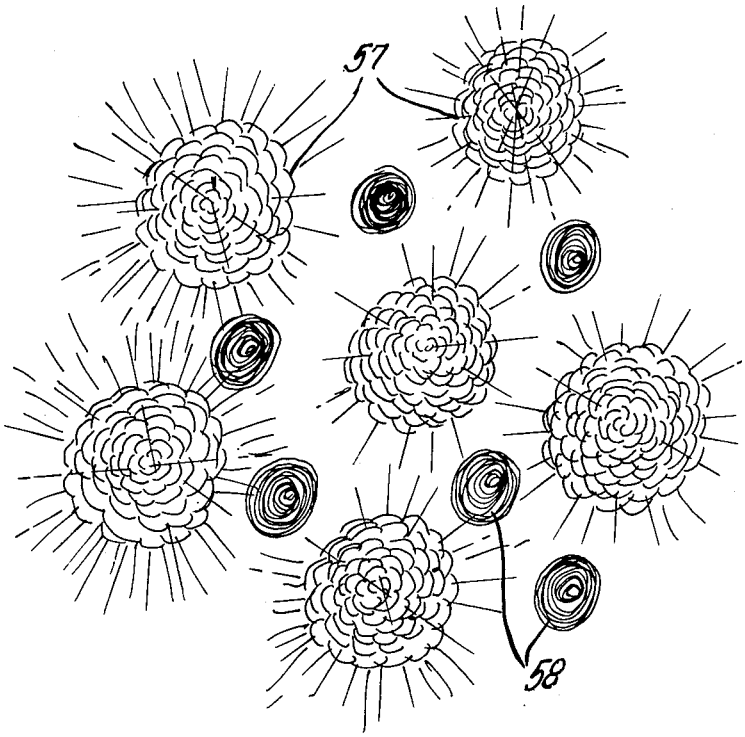
FIG. 4 is a representation of a photomicrograph taken at 160 times magnification of a cross section of a sprayed coating produced in accordance with one embodiment of the invention.

The mechanism by which the flame intensity is obtained is believed to be due to the spontaneous burst of thermal energy of each of the NiO-Al agglomerates, as depicted in FIG. 4 which shows a plurality of heat generating sites 57 surrounding the coating material 58 of, for example, nickel or nickel-base alloys.

In producing the metallo-thermic agglomerate, the finely divided reducible metal oxide powder is mixed with a metal reducing agent and with a proper amount of a fugitive bonding agent, such as a resin, or other adhesive, e.g., alkali metal silicate. One example of a fugitive bonding agent is methyl methacrylate dissolved in methyl ethyl ketone. The amount of resin employed corresponds on a dry basis with respect to the total weight of ingredients present of about 2% to 3% by weight following evaporation of the solvent. Broadly speaking, the amount of binder on the dry basis may range from about 1% to 5% of the total weight of the ingredients being agglomerated.

Examples of resins which may be employed are the acrylates, e.g., methyl methacrylate, polyvinyl chloride, polyurethane, polyvinyl alcohol, and the like. The resins are employed as solutions, that is, dissolved in a compatible volatile organic solvent, such as alcohols, methyl ethyl ketone (MEK), xylol, and the like, and the solution in predetermined amounts mixed with the powdered ingredients and solvent evaporated to leave behind bonded agglomerates which are sized by passing the agglomerates through a screen of 100 mesh and preferably through 140 mesh. Examples of alkali metal silicates are sodium silicate and potassium silicate which are soluble in water. The mixing and agglomeration may be carried out in a Hobart mixer manufactured by the Hobart Manufacturing Company of Troy, Ohio, or by using the spray drying technique disclosed in U.S. Pat. Nos. 1,601,898 and 3,373,119.

In one embodiment of the invention, NiO and aluminum are agglomerated together using a phenolic resin (e.g., phenolformaldehyde) in a solvent (ethyl alcohol) as the bonding agent to provide, following drying at 350° F. (177° C.), a retained amount of about 3% resin by weight in said agglomerate. Predetermined amounts of the agglomerates of average size ranging from about 30 to 150 microns are then mixed with nickel powder of average size ranging from about 30 to 150 microns, the composition of the total mix including the metal content being about 25% NiO, 25% Al and 50% of Ni by weight. The powder is then flame sprayed onto a clean substrate of a 1020 steel using an oxyacetylene gravity feed torch of the type shown, by way of example, in FIG. 1 to produce a strongly adherent bond coat.

As stated earlier, other metal oxides may be employed, such as iron oxide, cobalt oxide, copper oxide, and the like, so long as the negative free energy of formation of the metal oxide ranges up to about 60,000 calories per gram atom of oxygen referred to 25° C. Likewise, other reducing metals may be employed, such as Ti, Mg, Ca, Cr, Si, etc., so long as the reducing metal has a negative free energy of oxidation of at least about 90,000 calories per gram atom of oxygen referred to 25° C.

The ratio of reducible metal oxide to the reducing metal in the agglomerate may range by weight from about 30% to 70% metal oxide and about 70% to 30% of reducible metal and, preferably, about 40% to 60% metal oxide and about 60% to 40% reducible metal. A preferred agglomerate is one comprising the alumino-thermic system NiO-Al.

The coating material which is mixed with the agglomerate may comprise such metals as Fe, Ni, Co, Cu, and iron-base, nickel-base, cobalt-base, and copper-base alloys, among other metals and alloys.

Other coating materials include refractory oxides and carbides, borides, silicides, and nitrides of refractory metals and of the 4th, 5th, and 6th Groups of the Periodic Table.

As illustrative of the invention, the following examples are given:

EXAMPLE 1

A water solution of sodium silicate is employed as a binder to agglomerate 50% by weight each of NiO and Al. The two ingredients each had an average size of about 5 microns and were agglomerated together in a Hobart mixer after adding sufficient sodium silicate solution (containing about 40% by weight of sodium silicate) to wet the powder mixture to ultimately provide an agglomerate containing about 2% by weight sodium silicate on the dry basis. The mixing is carried out at a temperature of about 150° C. until the water is evaporated to provide an agglomerate having an average size falling within the range of about 30 to 150 microns, the amount of sodium silicate in the agglomerate as stated above being about 2% by weight on the dry basis.

The aforementioned agglomerate was mixed with nickel powder (about 30 to 75 microns) at a ratio of 50:50 and flame sprayed using an oxyacetylene torch of the type illustrated in FIG. 1, the metal substrate being a grit blasted 1020 steel. The bond strength obtained was 7,245 psi.

As will be noted, a very good bond strength was obtained. A similar test was conducted using an agglomerate comprising 95% nickel powder bonded to 5% by weight of aluminum powder by means of a fugitive resin binder of phenolic (phenolformaldehyde) in an amount corresponding to about 3% by weight of the total nickel and aluminum content. The agglomerate was sprayed using the same torch of the type shown in FIG. 1 and a bonding strength of about 5700 psi obtained which is much lower than the value obtained with the alumino-thermic composition hereinabove.

Referring to FIGS. 4, 5 and 6 photomicrographs are shown of cross sections of the coatings (160 times magnification) produced in accordance with the invention as described in Example 1. The coating obtained is hard by virtue of the presence of dispersed oxides (black areas) and has a high bonding strength.

The bond strength was determined according to ASTM designation C633-69. The determination is made by using a set of two cylindrical blocks one inch in diameter and one inch long. An end face of each block of the set is roughened by grit blasting and one face coated with the aforementioned bond coat compositions by flame spraying to a thickness of about 0.008 to 0.012 inch. A high strength overcoat is applied to the bond coat, the high strength overcoat being a nickel-base alloy known by the trademark Inconel (7% Fe-15% Cr-balance Ni) which has a bond strength of over 10,000 psi, that is, much higher than the bond coat being tested. The thickness of the high strength overcoat is about 0.015 to 0.020 inch, and after depositing it, the overall coating which has a thickness ranging up to about 0.025 inch is then finished ground to about 0.015 inch. A layer of epoxy resin is applied to the overcoat layer, the epoxy layer having a bond strength of over 10,000 psi.

The other block of the set is similarly end ground to a smoothness corresponding to 20 to 30 rms and a layer of high strength epoxy resin applied to it. The two blocks of the set, one with the metal coating and the epoxy layer is clamped to the other with the epoxy faces of the blocks in abutting contact and the clamped blocks subjected to heating in an oven to 300° F. (150° C.) for one hour, whereby the epoxy faces strongly adhere one to the other to provide a strongly bonded joint.

The joined blocks are then pulled apart using anchoring bolts coaxially mounted on opposite ends of the joined blocks using a tensile testing machine for recording the breaking force. The bonding strength is then determined by dividing the force obtained at failure by the area of the one inch circular face of the blocks.

Tests have shown that while the metallo-thermic composition provides new and improved results, the desired results are not achieved by flame spraying the metallo-thermic agglomerates alone followed by the separate step of flame spraying the coating material in that the metallo-thermic composition alone does not provide an adequate bond coat. In this connection, the use of the metallo-thermic composition differs from the intermetallic-forming composition of, for example, the Ni-Al composite.

To illustrate the foregoing, the following tests were conducted:

A series of metallo-thermic agglomerate compositions was prepared based on the alumino-thermic system NiO-Al comprising by weight (1) 80% NiO-20% Al, (2) 60% NiO-40% Al, (3) 40% NiO-60% Al, and (4) 20% NiO-80% Al. Each composition was prepared by mixing a batch of the powder mixture with a solution containing about 3.3% by weight of sodium silicate binder, the average size of each powder ingredient being about 2 to 10 microns, the amount of solution being sufficient to wet the powder mixture and ultimately provide agglomerates containing about 2% of said binder on the dry basis.

The mixing was carried out at a temperature of about 150° C. until the solution was evaporated to dryness and the residue screened to provide agglomerates having an average particle size ranging from plus 325 mesh to minus 140 mesh (35 to 105 microns).

Each of the foregoing metallo-thermic compositions was flame sprayed alone on a grit-blasted one-inch diameter 1020 steel using a torch designated as the Rototec Model I Torch sold by the Eutectic Corporation and corresponding to the gravity fed torch shown in FIG. 1. A thin 0.010 inch thick bond coat deposit was flame sprayed of each of the compositions. This was then followed by the flame spraying of a top coat of a nickel-base alloy (15% Cr, 7% Fe, and the balance nickel), the alloy having an average particle size ranging from about 30 to 75 microns.

During spraying, the top coat formed on the bond coat deposit. However, the bond cost deposit produced from the NiO/Al agglomerate began peeling off the substrate leaving some bonded particles. The peeling continued throughout the spray operation. The following observations were made:

| Deposit | Bonded Particles |
|---|---|
| 80 NiO - 20 Al | 10% |

-continued

| Deposit | Bonded Particles |
|---|---|
| 60 NiO - 40 Al | 50% |
| 40 NiO - 60 Al | 50% |
| 20 NiO - 80 Al | 10% |

As will be apparent, the peeling off of the top coat indicates poor adhesive as well as poor cohesive bond strength.

On the other hand, when agglomerates based on a composite of nickel and aluminum (95% Ni-5% Al) were similarly sprayed, the resulting coating exhibited a bond strength in the order of 5000 psi as determined according to ASTM C633-69.

However, when the NiO/Al agglomerate is mixed with coating metal and flame sprayed under the same conditions as in Example 1, markedly improved bonding is obtained. As will be appreciated, the metallo-thermic system is a heat generating system only and does not correspond to the composite system Ni-Al.

The metallo-thermic system can be employed in a variety of ways. For example, the NiO-Al agglomerate may be blended with the Ni-Al agglomerate and with the primary coating material. Or, if it is desirable, the metallo-thermic agglomerate may be mixed with agglomerates of refractory metal disilicide and with coating alloy, e.g., a nickel-base alloy. Or, as another embodiment, the metallo-thermic agglomerate may be mixed with agglomerates of refractory metal disilicide, e.g., $TiSi_2$, should a disilicide-rich coating be desired.

As illustrative of other embodiments of the invention, the following additional examples are given:

EXAMPLE 2

A powder blend was produced containing three ingredients: (1) 50% by weight of a Ni-Al agglomerate containing 95% Ni and 5% Al held together by a fugitive binder of phenolic resin (corresponding to 2% dry weight of the total nickel and aluminum content), (2) 25% by weight of agglomerated NiO-Al produced by spray drying a 50 NiO-50 Al mixture of particle size ranging from about 2 to 10 microns using sodium silicate as a binder (2% on the dry basis), and (3) 25% by weight of a nickel-base alloy containing 7% silicon and the balance essentially nickel.

The average particle size of the agglomerates fell within the range of about 30 to 150 microns and of the alloy within the range of about 30 to 105 microns.

Following spraying of the powder mix on a grit-blasted 1020 steel substrate, the bond strength was determined to be about 7,213 psi in accordance with ASTM C633-69.

A photomicrograph of the coating taken at 160 times magnification is shown in FIG. 6.

EXAMPLE 3

The following flame spray powder mix was produced:

(1) 25% by weight of an agglomerate of 95 Ni-5 Al to which has been agglomerated additional aluminum (20% by weight of average particle size 2 to 10 microns);

(2) 25% by weight of a spray dried agglomerate of NiO-Al (50% Ni-50% Al); and (3) 50% by weight of a Ni-Si alloy (93% Ni and 7% Si).

The powder blend which had an average particle size falling within the range of about 30 to 150 microns was flame sprayed as in Example 1 onto a grid-blasted 1020 steel substrate. The bond strength was 4,076 psi.

EXAMPLE 4

A flame spray powder blend was produced having the following composition:

(1) 25% by weight of the spray dried NiO-Al agglomerate as in Example 1 (50 NiO-50 Al); and (2) 75% by weight of a pre-reacted alloy of 95% Ni-5% Al.

The powder blend which had an average particle size falling within the range of about 30 to 150 microns was flame sprayed as in Example 1 to provide a bond coat with a bond strength of about 7,175 psi.

EXAMPLE 5

The following powder blend composition was produced as follows:

(1) 25% by weight of spray dried NiO-Al agglomerates (50% NiO-50% Al);

(2) 25% by weight of Ni-Si alloy containing 93% Ni-7% Si; and (3) 50% by weight of a pre-reacted alloy of 95% Ni-5% Al.

The powder blend which had an average particle size falling within the range of about 30 to 150 microns produced a good bond coat on a 1020 steel substrate of bond strength of about 6,804 psi.

EXAMPLE 6

Bond coats were also produced from the following powder blend compositions:

Composition A (1) 25% by weight of spray dried NiO-Al agglomerates (50% NiO-50% Al);

(2) 25% by weight of the pre-reacted alloy of 95% Ni-5% Al; and (3) 50% by weight of the alloy 93% Ni-7% Si.

The powder blend which had an average particle size falling within the range of about 30 to 150 microns produced a coating with a bond strength of about 5,996 psi.

Composition B (1) 50% by weight of the pre-reacted alloy of 95% Ni-5% Al; and (2) 50% by weight of spray dried NiO-Al agglomerates (50% NiO-50% Al).

The powder blend which had an average particle size falling within the range of about 30 to 150 microns produced a coating with a bond strength of about 2,770 psi.

Composition C (1) 50% by weight of spray dried NiO-Al agglomerates (50% NiO-50% Al);

(2) 25% by weight of the pre-reacted alloy 95% Ni-5% Al; and (3) 25% by weight of the alloy Ni-Si (93% Ni-7% Si).

The powder blend which had an average particle size falling within the range of about 30 to 150 microns produced a coating with a bond strength of about 2,505 psi.

Composition D (1) 50% by weight of a composite of 95% Ni-5% Al (agglomerate) cladded with 5% by weight of $TiSi_2$ by means of an adhesive; and (2) 50% by weight of spray dried agglomerates of NiO-Al (50% Ni-50% Al).

The powder blend which had an average particle size falling within the range of about 30 to 150 microns produced a coating with a bond strength of about 2,739 psi.

Composition E (1) 50% by weight of a composite 95% Ni-5% Al (agglomerate) cladded with 5% by weight of $TiSi_2$ by means of an adhesive;

(2) 25% by weight of spray dried agglomerates of NiO-Al (50% NiO-50% Al); and (3) 25% by weight of the Ni-Si alloy (93% Ni-7% Si).

The powder blend which had an average particle size falling within the range of about 30 to 150 microns produced a coating with a bond strength of about 3,493 psi.

As will be clearly apparent, many powder blend combinations are possible using the metallo-thermic system as the heat generating source. Normally, the pre-reacted alloy (95% Ni-5% Al) is very difficult to bond. Generally speaking, bond strengths of at least about 2,500 or 3,000 psi are acceptable for all bond coats. Examples of additional flame spray compositions in accordance with the invention are as follows:

| Example | Composition |
|---|---|
| 7 | 50% by weight $Fe_2O_3$-Al (60% $Fe_2O_3$- 40% Al) agglomerates<br>50% by weight atomized nickel powder |
| 8 | 25% by weight CoO-Mg (40% CoO - 60% Mg) agglomerates<br>75% by weight 18/8 stainless steel |
| 9 | 40% by weight CuO-Ti (30% CuO - 70% Ti) agglomerates<br>60% by weight aluminum bronze (85% Cu - 10% Al - 5% Ni) |
| 10 | 20% by weight $Cu_2O$-Si (80% $Cu_2O$ - 20% Si) agglomerates<br>80% by weight of copper alloy (90% Cu - 10% Zn) |
| 11 | 25% by weight $Fe_2O_3$-Al (40% $Fe_2O_3$- 60% Al) agglomerates<br>25% by weight Ni-Al agglomerates (90% Ni - 10% Al)<br>25% by weight of agglomerated $TiSi_2$<br>25% by weight of atomized nickel powder |
| 12 | 25% by weight of NiO-Al agglomerates (65% NiO - 35% Al)<br>50% nickel-base alloy (2% Si, 2% B, 10% Cr, bal. Ni)<br>25% WC (agglomerated) |
| 13 | 40% by weight CoO-Al agglomerates (50% CoO - 50% Al)<br>40% cobalt-base alloy (15% W, 25% Cr, bal. Co)<br>20% TiC agglomerated |

The heat generating metallo-thermic composition may be employed over a relatively broad range of compositions.

It is preferred that the average size of the reducible metal oxide and the reducing agent in the agglomerate have an average particle size ranging up to about 20 microns, generally less than 15 microns, and usually range from about 2 to 10 microns, the average size of the agglomerate ranging from about 30 to 150 microns.

The composition of the heat generating agglomerate may range by weight from about 30% to 70% reducible metal oxide and 70% to 30% metallic reducing agent and, more preferably, range from about 40% to 60% reducible metal oxide and 60% to 40% metallic reducing agent.

The amount of heat generating agglomerates in the powder blend may range by weight from about 10% to 80% with the remaining material in the blend, e.g., coating material, ranging from about 90% to 20%. A preferred range is about 20% to 60% heat generating agglomerates and 80% to 40% of the coating material. A nickel-aluminum composite (e.g., agglomerate) powder may also be added to the powder blend in amounts ranging up to about 50% by weight of the total mixture.

Where a nickel-aluminum composite is employed as part of the flame spray powder mix or blend, the composite may comprise about 75% to 98% by weight of nickel and 2% to 25% by weight of aluminum, either metal cladding the other. It is preferred to employ nickel or nickel alloy powder cladded with aluminum in the form of an agglomerate, the two metals being bonded together by a fugitive binder as described hereinbefore. The agglomerate may also contain up to 15% by weight of refractory compounds such as carbides, borides, silicides, and nitrides of the refractory metals of the 4th, 5th, and 6th Groups of the Periodic Table.

As stated hereinbefore, the agglomerates can be mixed with such coating metals as nickel-base, cobalt-base, iron-base, and copper-base alloys, as well as nickel, cobalt, iron, and copper per se, among many other coating materials.

The preferred alloys are those which are self-fluxing and having a melting point ranging from about 870° C. to 1288° C. (1600° F. to 2350° F.), it being understood that the alloys need not be self-fluxing. The self-fluxing alloys include those containing at least one of the metals selected from the group consisting of about 0.5% to 6% of silicon and 0.5% to 5% boron.

Examples of such alloys are given as follows:

NICKEL-BASE MATRIX ALLOY

| Constituent | Range in Percent By Weight | Example |
|---|---|---|
| Silicon | 1.5–5.0 | 3.0 |
| Boron | 1.5–5.0 | 2.0 |
| Chromium | 0–20 | 1.0 |
| Molybdenum | O–7 | 0.2 |
| Nickel | (1) | (1) |

(1) Essentially the balance.

The above alloy may be substituted in nickel content by cobalt or iron. Also, alloys of this type can consist as a matrix containing refractory carbide particles (e.g., WC) in a fine particle size to effect a further improvement in abrasion resistance. The following matrix alloy may be employed.

COBALT-BASE MATRIX ALLOY

| Constituent | Range in Percent By Weight | Example |
|---|---|---|
| Nickel | 1. –5.0 | 3.0 |
| Chromium | 20.0–32.0 | 28.0 |
| Silicon | 0.5–3.0 | 1.0 |
| Boron | 1.0–3.0 | 2.0 |
| Carbon | 0.8–2.0 | 1.0 |
| Tungsten | 3.5–7.5 | 4.5 |
| Molybdenum | 0.0–5.0 | 3.0 |
| Cobalt | (1) | 57.5 |

(1) Essentially the balance.

Again, nickel or iron may be substituted in the above formulation for a like amount of cobalt.

A particularly preferred copper-base matrix alloy which has been found useful has the following constituents in percentages by weight as indicated:

COPPER-BASE ALLOY

| Constituent | Broad Range | Intermediate Range |
|---|---|---|
| Nickel | 15.0–40.0 | 20–25 |
| Silicon | 1.0–5.0 | 3.0–4.0 |
| Boron | 0.15–2.50 | 0.25–0.5 |
| Manganese | 0.20–2.00 | 0.5–1.0 |
| Copper | (1) | (1) |

(1) Essentially the balance.

As an example of a matrix alloy within the above ranges, there may be mentioned:

| Constituents | Percent by Weight |
|---|---|
| Nickel | 23.00 |
| Silicon | 3.45 |
| Boron | 0.47 |
| Manganese | 0.75 |
| Copper | (1) |

(1) Essentially the balance.

The foregoing alloys are preferably employed as atomized powders. A particular nickel-base alloy is one containing about 3% Si, 2% B, 1% Cr, 0.2% Mo, and the balance essentially nickel. It is preferred that the average size of the coating metal range from minus 200 mesh to plus 325 mesh.

As-sprayed coatings of substantial thickness may be produced in accordance with the invention, e.g., coating thicknesses of up to about 0.25 inch, e.g., about 0.01 to 0.125 inch.

While the sprayed metal coating of the invention has shown particular applicability to ferrous metal substrates, the sprayed metal coating is also compatible with metal substrates comprising nickel, cobalt, aluminum-base alloys and copper substrates, among other compatible substrates, e.g., certain non-metal substrates.

The term "agglomerates" employed herein is intended to include a composite particle in which a core constituent is cladded by means of a fugitive binder with at least one other constituent, or a composite particle in which two or more constituents are randomly bonded together by a fugitive binder.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A method of producing an adherent bond coat on a substrate which comprises, flame spraying onto said metal substrate a powder mixture formed of agglomerates of a metallo-thermic heat-generating composition mixed with a coating material, said agglomerates of metallo-thermo heat-generating composition comprised essentially of fine particles of a reducible metal oxide formed from a metal characterized by a negative free energy of oxidation ranging up to about 60,000 calories per gram atom of oxygen referred to 25° C. intimately combined together by means of a thermally fugitive binder with fine particles of a strong reducing agent consisting essentially of a metal characterized by a negative free energy of oxidation referred to 25° C. of at least about 90,000 calories per gram atom of oxygen, said agglomerates being uniformly mixed in an amount ranging from about 10% to 80% by weight with about 90% to 20% by weight of at least one coating material selected from the group consisting of metals, alloys, refractory oxides, and carbides, silicides, nitrides, and borides of the refractory metals of the 4th, 5th, and 6th Groups of the Periodic Table, and continuing said spraying to form an adherent bond coat on said substrate.

2. The method of claim 1, wherein the metal oxide and the reducing agent in the agglomerate have an average particle size varying up to about 20 microns.

3. The method of claim 1, wherein the average size of the agglomerates and the coating material in the powder mixture ranges from about 30 to 150 microns.

4. The method of claim 1, wherein the amount of metal oxide in the agglomerate ranges by weight from about 30% to 70% and the amount of reducing agent ranges from about 70% to 30%.

5. The method of claim 1, wherein the amount of agglomerates ranges by weight from about 20% to 60% and the amount of coating material ranges from about 80% to 40%.

6. The method of claim 1, wherein the metal oxide is NiO and the reducing agent is Al.

7. The method of claim 6, wherein the average size of the agglomerates and the coating material in the powder mixture ranges from about 30 to 150 microns.

8. The method of claim 6, wherein the amount of NiO in the agglomerate ranges from about 30% to 70% by weight and the amount of Al ranges from about 70% to 30%.

9. The method of claim 6, wherein the amount of agglomerates ranges by weight from about 20% to 60% and the amount of coating material ranges from about 80% to 40%.

10. The method of claim 9, wherein the coating material is selected from the group consisting of Fe, Ni, Co, Cu and Fe-base, Ni-base, Co-base and Cu-base alloys.

11. A method of producing an adherent bond coat on a metal substrate which comprises, flame spraying onto said metal substrate a powder mixture formed of agglomerates of an aluminothermic heat generating composition mixed with a coating material, said agglomerates of heat-generating alumino-thermic composition comprised essentially of fine particles of nickel oxide intimately combined together with fine particles of aluminum by means of a thermally fugitive binder, said agglomerates being uniformly mixed in an amount ranging from about 10% to 80% by weight with about 90% to 20% by weight of at least one coating material selected from the group consisting of Fe, Ni, Co, Cu and Fe-base, Ni-base, Co-base and Cu-base alloys, and continuing said spraying to form an adherent bond coat on said substrate.

12. The method of claim 11, wherein the nickel oxide and aluminum in the agglomerate have an average particle size ranging up to about 20 microns.

13. The method of claim 12, wherein the average size of the agglomerates and the coating material in the powder mixture ranges from about 30 to 150 microns.

14. The method of claim 13, wherein the amount of nickel oxide by weight ranges from about 30% to 70% and the amount of aluminum ranges from about 70% to 30%.

15. The method of claim 11, wherein the amount of agglomerates ranges by weight from about 20% to 60% and the amount of coating material ranges from about 80% to 40%.

16. The method of claim 12, wherein the coating material is nickel or a nickel-base alloy.

* * * * *